US005354485A

United States Patent [19]

Tipton et al.

[11] Patent Number: 5,354,485

[45] Date of Patent: Oct. 11, 1994

[54] LUBRICATING COMPOSITIONS, GREASES, AQUEOUS FLUIDS CONTAINING ORGANIC AMMONIUM THIOSULFATES

[75] Inventors: Craig D. Tipton, Perry; Daniel E. Barrer, Euclid; Nai Z. Huang, Mayfield Heights; John M. Cahoon, Mentor, all of Ohio

[73] Assignee: The Lubrizol Corporation, Wickliffe, Ohio

[21] Appl. No.: 37,916

[22] Filed: Mar. 26, 1993

[51] Int. Cl.[5] ..... C10M 133/52; C10M 133/54

[52] U.S. Cl. ..... 252/34; 252/47.5

[58] Field of Search ..... 252/34, 47.5

[56] References Cited

U.S. PATENT DOCUMENTS

| | | | |
|---|---|---|---|
| 3,197,405 | 7/1965 | Le Suer | 252/32.7 |
| 3,505,222 | 4/1970 | Niebylski | 252/17 |
| 3,505,223 | 8/1970 | Niebylski | 252/25 |
| 3,544,465 | 12/1970 | Braid | 252/46.6 |
| 4,089,790 | 5/1978 | Adams | 252/18 |
| 4,308,154 | 12/1981 | Clason et al. | 252/32.7 |
| 4,336,148 | 6/1982 | Wirth et al. | 252/49.7 |
| 4,404,408 | 9/1983 | Wirth et al. | 568/680 |
| 4,417,990 | 11/1983 | Clason et al. | 252/32.7 |
| 4,584,115 | 4/1986 | Davis | 252/49.6 |
| 4,670,169 | 6/1987 | Adams et al. | 252/46.7 |
| 4,732,691 | 3/1988 | Wirth et al. | 252/47.5 |
| 4,744,920 | 5/1988 | Fischer et al. | 252/33.4 |
| 4,770,807 | 9/1988 | Musikas et al. | 252/184 |
| 4,792,410 | 12/1988 | Schwind et al. | 252/38 |
| 4,876,374 | 10/1989 | Adams et al. | 558/109 |
| 4,923,625 | 5/1990 | King | 252/32.5 |
| 4,962,227 | 10/1990 | Wirth et al. | 252/32.5 |
| 5,021,175 | 6/1991 | Germanaud et al. | 252/46.6 |
| 5,062,977 | 11/1991 | Germanaud et al. | 252/48.2 |

*Primary Examiner*—John Niebling
*Assistant Examiner*—Edna Wong
*Attorney, Agent, or Firm*—Frederick D. Hunter; Forrest L. Collins; John H. Engelmann

[57] ABSTRACT

This invention relates to a composition comprising a major amount of an oil of lubricating viscosity, and (A) an organic ammonium thiosulfate. The lubricating composition is either free of added lead containing compounds or additionally contains (B) a phosphorus or boron antiwear/extreme pressure agent, or both. The invention also includes greases and aqueous fluids containing organic ammonium thiosulfates. These compositions have improved antiwear, antiweld, extreme pressure and/or friction properties.

25 Claims, No Drawings

LUBRICATING COMPOSITIONS, GREASES, AQUEOUS FLUIDS CONTAINING ORGANIC AMMONIUM THIOSULFATES

TECHNICAL FIELD OF THE INVENTION

This invention relates to compositions containing organic, i.e., carbon containing, ammonium thiosulfate. These compositions include lubricating compositions, greases, and aqueous fluids.

BACKGROUND OF THE INVENTION

Lubricating compositions, greases, and aqueous fluids are used to maintain a film of lubricant between surfaces which are moving with respect to each other. The compositions prevent contact of the moving surfaces thus preventing harmful wear to the surfaces. The compositions generally also lower the coefficient of friction. To be effective, the compositions must have sufficient antiwear, antiweld, and extreme pressure properties to prevent metal-to-metal contact under high load conditions. There is a desire to have a material or combinations of materials which provide lubricating compositions with antiwear, antiweld, extreme pressure and/or friction properties.

One problem associated with boundary lubrication occurs under high speed, shock loading conditions. Under these conditions, the lubricant is exposed to a quick heavy load which may cause metal-to-metal contact. The L-42 high speed, shock loading test measures a lubricants ability to protect under high speed, shock loading conditions.

U.S. Pat. No. 3,505,222, issued to Niebylski relates to lubricant compositions having extreme pressure wear properties. The lubricants contain a synergistic mixture of a thiosulfate compound and a lead compound. The thiosulfates include metal thiosulfates and quaternary ammonium thiosulfates. The lead compounds include lead naphthenate, lead imidazole, lead isodecyl xanthogenate, lead oleate, lead stearate, lead sulfide, and lead octyl xanthogenate.

U.S. Pat. No. 4,923,625 relates to lubricant compositions with improved extreme pressure and antiwear properties which contain a mixture of a metal thiosulfate and a metal phosphate.

SUMMARY OF THE INVENTION

This invention relates to a composition comprising a major amount of an oil of lubricating viscosity, and (A) an organic ammonium thiosulfate. The lubricating composition is either free of added lead containing compounds or additionally contains (B) a phosphorus or boron antiwear/extreme pressure agent, or both. The invention also includes greases and aqueous fluids containing organic ammonium thiosulfates. These compositions have improved antiwear, antiweld, extreme pressure and/or fiction properties.

DESCRIPTION OF THE PREFERRED EMBODIMENTS

The term "hydrocarbyl" includes hydrocarbon as well as substantially hydrocarbon groups. Substantially hydrocarbon describes groups which contain heteroatom substituents which do not alter the predominantly hydrocarbon nature of the group. Examples of hydrocarbyl groups include the following:

(1) hydrocarbon substituents, i.e., aliphatic (e.g., alkyl or alkenyl), alicyclic (e.g., cycloalkyl, cycloalkenyl) substituents, aromatic-, aliphatic- and alicyclic-substituted aromatic substituents and the like as well as cyclic substituents wherein the ring is completed through another portion of the molecule (that is, for example, any two indicated substituents may together form an alicyclic radical);

(2) substituted hydrocarbon substituents, i.e., those substituents containing non-hydrocarbon groups which, in the context of this invention, do not alter the predominantly hydrocarbon nature of the substituent; those skilled in the art will be aware of such groups (e.g., halo (especially chloro and fluoro), hydroxy, mercapto, nitro, nitroso, sulfoxy, etc.);

(3) heteroatom substituents, i.e., substituents which will, while having a predominantly hydrocarbon character within the context of this invention, contain an atom other than carbon present in a ring or chain otherwise composed of carbon atoms (e.g., alkoxy or alkylthio). Suitable heteroatoms will be apparent to those of ordinary skill in the art and include, for example, sulfur, oxygen, nitrogen and such substituents as, e.g., pyridyl, furyl, thienyl, imidazolyl, etc.

In general, no more than about 2, preferably no more than one, hetero substituent will be present for every ten carbon atoms in the hydrocarbyl group. Typically, there will be no such hetero atom substituents in the hydrocarbyl group. Therefore, the hydrocarbyl group is purely hydrocarbon.

As described above, the compositions of the present invention include organic ammonium thiosulfates. The term organic refers to ammonium thiosulfates which contain carbon atoms. The organic ammonium thiosulfate may be prepared by any means known to those in the art. The organic ammonium thiosulfate is generally formed using an amine.

The amine may be a primary, secondary, or tertiary amine. Generally, the amine is a monoamine, although polyamines, such as alkylene polyamines and condensed polyamines described herein, may also be used. In one embodiment, the amine generally contains one or more hydrocarbyl groups each independently containing from about 4, or from about 8, or from about 10 up to about 30, or up to about 24, or up to about 18 carbon atoms. Examples of monoamines include octylamine, decylamine, dodecylamine, hexadecylamine, and octadecylamine. Examples of secondary amines include dioctylamine, didodecylamine, methyldodecylamine, ethylhexadecylamine, etc. Tertiary amines include tris(octyl)amine, tris(decyl)amine, methyldidodecylamine, etc. Amines which may be used to form the organic ammonium thiosulfate are described in U.S. Pat. No. 4,234,435. This patent is incorporated by references for its disclosure of amines.

In one embodiment, the amine is a primary amine. Useful primary amines include primary ether amines and tertiary aliphatic primary amines. Ether amines refers to amines which contains at least one ether linkage in the organic, i.e., carbon containing, portion of the amine. The ether amine may contain more than one ether linkage and would then be referred to as a polyoxyalkylene amine. Generally, when the ether amine is a polyoxyalkylene amine, the amine contains from about 2, or from about 10, up to about 150, or up to about 100 oxyalkylene groups. In another embodiment, the ether amine contains only one ether linkage.

In one embodiment, the ether amine is represented by the formula $R_1(OR_2)_xNH$ wherein $R_1$ is a hydrocarbyl group having from about 4 to about 30 carbon atoms, $R_2$. is a divalent hydrocarbylene group, usually an alkylene group having from 2 to about 6 carbon atoms, and x is a number greater than zero. In another embodiment, $R_1$ contains from about 6, or from about 8, or from about 12 up to about 30, or up to about 24, or up to about 18 carbon atoms. $R_2$ is generally a methylene, ethylene or propylene group. Generally, x is a number from 1 up to about 30, or up to about 10, or up to about 5. In one embodiment, x equals one.

Commercially available ether amines are SURFAM® amines, produced and marketed by Mars Chemical Company, Atlanta, Ga. Preferred ether amines are exemplified by those identified as SURFAM® P14B (decyloxypropylamine), SURFAM® P16A (linear $C_{16}$), SURFAM® P17B (tri- decyloxypropylamine). The carbon chain lengths of the SURFAM® amines described above and used hereinafter are approximate and include the oxygen ether linkage. For example, a $C_{14}$ SURFAM® amine would have the following general formula $C_{10}H_{21}OC_3H_6NH_2$.

In another embodiment, the organic ammonium thiosulfate of this invention is derived from tertiary aliphatic primary amines having from one, or from about 4, or from about 6, or from about 8 up to about 30, or up to about 24, or up to about 18 carbon atoms in the alkyl group. The tertiary aliphatic primary amines include those represented by the formula

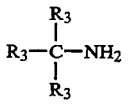

wherein each $R_3$ is independently a hydrocarbyl group containing from one to about 30 carbon atoms. Such primary amines are illustrated by tertiary-butyl amine, tertiary-hexyl amine, 1-methyl-1-amino-cyclohexane, tertiary-octyl amine, tertiary-decyl amine, tertiary-dodecyl amine, tertiary-tetradecyl amine, tertiary-hexadecyl amine, tertiary-octadecyl amine, tertiary-tetracosanyl amine, tertiary-octacosanyl amine.

Mixtures of amines are also useful for the purposes of this invention. Illustrative of amine mixtures of this type are "Primene 81R", which is a mixture of $C_{11}$–$C_{14}$ tertiary alkyl primary amines, and "Primene JMT", which is a similar mixture of $C_8$–$C_{22}$ tertiary alkyl primary amines, both of these amines are available from Rohm and Haas Company. The tertiary alkyl primary amines and methods for their preparation are known to those of ordinary skill in the art. The tertiary alkyl primary amine useful for the purposes of this invention and methods for their preparation are described in U.S. Pat. No. 2,945,749 which is hereby incorporated by reference for its teaching in this regard.

In one embodiment, the amine may be a fatty ($C_{4-30}$) amine which include n-hexylamine, n-octylamine, n-decylamine, n-dodecylamine, n-tetradecylamine, n-hexadecylamine, n-octadecylamine, oleyamine, etc. Also useful fatty amines include commercially available fatty amines such as "Armeen" amines (products available from Armak Chemicals, Chicago, Ill.), such as Armak's Armeen-C, Armeen-O, Armeen-OL, Armeen-T, Armeen-HT, Armeen S and Armeen SD, wherein the letter designation relates to the fatty group, such as cocoa, oleyl, tallow, or stearyl groups.

The amine used to form the organic ammonium thiosulfate may also be an acylated amine, a hydrocarbyl substituted amine, a Mannich reaction product, or a post treated product thereof.

The amine may also be a polyamine. The polyamine may be aliphatic, cyclo-aliphatic, heterocyclic or aromatic. Examples of the polyamines include fatty polyamine diamines, alkylenepolyamines, hydroxy containing polyamines, arylpolyamines, and heterocyclic polyamines. The fatty polyamine diamines include mono- or dialkyl, symmetrical or asymmetrical ethylene diamines, propane aliamines (1,2, or 1,3), and polyamine analogs of the above. Suitable commercial fatty polyamines are Duomeen C (N-coco- 1,3-diaminopropane), Duomeen S (N-soya-1,3-diaminopropane), Duomeen T (N-tallow-1,3-diaminopropane), and Duomeen O (N-oleyl-1,3-diaminopropane). "Duomeens" are commercially available from Armak Chemical Co., Chicago, Ill. In one embodiment, the secondary amines may be cyclic amines such as piperidine, piperazine, morpholine, etc.

Alkylenepolyamines include ethylenediamine, triethylenetetramine, tris-(2-aminoethyl)amine, propylenediamine, trimethylenediamine, tripropylenetetramine, tetraethylenepentamine, hexaethyleneheptamine, pentaethylenehexamine, etc. Higher homologs may be obtained by condensing two or more of the above-noted alkylene amines. A typical sample of such ethylenepolyamine bottoms obtained from the Dow Chemical Company of Freeport, Tex. designated "E-100". These alkylenepolyamine bottoms include cyclic condensation products such as piperazine and higher analogs of diethylenetriamine, triethylenetetramine and the like.

Another useful polyamine is a condensation reaction product of at least one hydroxy compound, such as polyhydric alcohols and amines, with at least one polyamine reactant containing at least one primary or secondary amino group. The hydroxy compounds are preferably polyhydric alcohols and amines. The polyhydric alcohols include alcohols containing from about two to about eight, or to about four hydroxy groups. These alcohols include ethylene glycol, glycerol, erythritol, and pentaerythritol. Preferably the hydroxy compounds are polyhydric amines. Polyhydric amines include monoamines reacted with an alkylene oxide (e.g., ethylene oxide, propylene oxide, butylene oxide, etc.) having two to about 20 carbon atoms, preferably two to about four. Examples of polyhydric amines include tri-(hydroxypropyl)amine, tris-(hydroxymethyl-)aminomethane, 2-amino-2-methyl-1,3-propanediol, N,N,N',N'-tetrakis (2-hydroxypropyl) ethylenediamine, and N,N,N',N'-tetrakis (2-hydroxyethyl) ethylenediamine, preferably tris(hydroxymethyl) aminomethane (THAM). The amine condensates and methods of making the same are described in U.S. Pat. Nos. 5,053,152 and 5,160,648, which are incorporated by reference for their disclosure to the condensates and methods of making. A particularly useful condensed polyamine is prepared by condensing HPA Taft Amines (amine bottoms available commercially from Union Carbide Co.) and tris(hydroxymethyl)aminomethane (THAM) in the presence of $H_3PO_4$.

The acylated nitrogen-containing compounds include reaction products of hydrocarbyl-substituted carboxylic acylating agents such as substituted carboxylic acids or derivatives thereof. These compounds include imides, amides, amidic acid or salts, heterocycles (imidazolines, oxazolines, etc.), and mixtures thereof. The hydrocarbyl-substituted carboxylic acylating agent may be derived from a monocarboxylic acid or a polycarboxylic acid. Polycarboxylic acids generally are preferred. The acylating agents may be a carboxylic acid or derivatives of the carboxylic acid such as the halides, esters, anhydrides, etc. Preferably the carboxylic acylating agent is a succinic acylating agent.

The hydrocarbyl-substituted carboxylic acylating agents include agents which have a hydrocarbyl group derived from a polyalkene. The polyalkenes include homopolymers and interpolymers of polymerizable olefin monomers of 2 to about 16, preferably 2 to about 4, more preferably 4 carbon atoms. The olefins include ethylene, propylene, 1-butene, isobutene, and 1-octene. Preferably, the interpolymer is a homopolymer, such as polybutene. The polyalkene is generally characterized as containing from at least about 8, or from at least about 30, or from at least about 35 up to about 300 carbon atoms, or up to 200, or up to 100 carbon atoms. In one embodiment, the polyalkene is characterized by an Mn (number average molecular weight) value of at least about 500. Generally, the polyalkene is characterized by an Mn value of about 500 to about 5000, preferably about 800 to about 2500. in another embodiment Mn varies between about 500 to about 1200 or about 1300.

In another embodiment, the hydrocarbyl group is derived from polyalkenes having an $\overline{M}n$ value of at least about 1300 up to about 5000, and the $\overline{M}w/\overline{M}n$ value is from about 1.5 to about 4, preferably from about 1.8 to about 3.6, more preferably about 2.5 to about 3.2.

The hydrocarbyl-substituted carboxylic acylating agents are prepared by a reaction of one or more of the above polyalkenes with one or more unsaturated carboxylic reagent, such as acids, anhydrides, esters, amides, imides, salts, acyl halides, and nitriles. Examples of useful unsaturated carboxylic acids include acrylic acid, methacrylic acid, maleic acid, fumaric acid, etc. Maleic acid or anhydride are particularly useful.

The acylated amines are typically referred to as succinimide or "Carboxylic" dispersants. Examples of acylated amines are described in British Patent 1,306,529 and in many U.S. patents including the following: U.S. Pat. Nos. 3,219,666, 3,340,281, 3,381,022, 3,444,170, 3,501,405, 3,576,743, 4,234,435, 5,053,152, 5,160,648 and Re 26,433.

The amine may also be a hydrocarbyl-substituted amine additive. These hydrocarbyl-substituted amines are well known to those skilled in the art. Typically, amine additives are prepared by reacting the above-identified olefins and the above-identified olefin polymers (polyalkenes) or chlorinated derivatives thereof with amines (mono- or polyamines). The amines may be any of the amines described, preferably polyalkylenepolyamines, more preferably ethylenepolyamines. Examples of the hydrocarbyl-substituted amine additives include poly(propylene)amines or polybutene amines such as N-poly(propylene)trimethylenediamine, N-poly(butene)diethylenetriamine, N',N'-poly(butene)-tetraethylenepentamine, and the like. These amines are disclosed in U.S. Pat. Nos. 3,275,554; 3,438,757; 3,454,555; 3,565,804; 3,755,433; and 3,822,289.

Mannich reaction products are the reaction products of alkylphenols in which the alkyl group contains at least about 30 carbon atoms and aldehydes (especially formaldehyde) and amines (especially amine condensates and polyalkylenepolyamines). The materials described in the following U.S. patents are illustrative: U.S. Pat. Nos. 3,036,003, 3,236,770, 3,414,347, 3,448,047, 3,461,172, 3,539,633, 3,586,629, 3,591,598, 3,634,515, 3,725,480, 3,726,882, and 3,980,569.

Post-treated products of the above materials are obtained by post-treating the acylated amines, the hydrocarbyl substituted amines or the Mannich reaction products with reagents such as urea, thiourea, carbon disulfide, aldehydes, ketones, carboxylic acids, hydrocarbon-substituted succinic anhydrides, nitriles, epoxides, boron compounds, phosphorus compounds or the like. Exemplary materials of this kind are described in the following U.S. Pat. Nos.: 3,200,107, 3,282,955, 3,367,943, 3,513,093, 3,639,242, 3,649,659, 3,442,808, 3,455,832, 3,579,450, 3,600,372, 3,702,757,and 3,708,422.

The above-noted patents are incorporated by reference herein for their disclosures of acylated amines, hydrocarbyl substituted amines, Mannich reaction products and, post treated products thereof and the components and methods of making the same.

In one embodiment, the organic ammonium thiosulfate is prepared by reacting ammonium thiosulfate with an amine. The organic ammonium thiosulfate is formed with the resultant release of ammonia. The reaction generally occurs at a temperature from about 70° C., or from about 90° C., up to about 150° C., or up to about 130° C. Generally from about 0.5, or from about 1 up to about 2 moles of amine are reacted with one mole of ammonium thiosulfate. A excess of amine may be used.

In another embodiment, the organic ammonium thiosulfate is prepared by reacting a mixture of an amine with a sulfurous acid, anhydride, or ester to form an intermediate. The intermediate is then reacted with a sulfur source. The reaction to form the intermediate may occur in the presence of water. Examples of sulfurous acids, arthydrides, and esters include sulfurous acid, ethylsulfonic acid, sulfur dioxide, thiosulfuric acid, dithionous acid, etc. The intermediate-forming reaction of the amine and sulfurous acid, anhydride, or ester occurs at a temperature from about 25° C., or from about 50° C. up to about 100° C., or up to about 80° C. Typically an excess of sulfurous acid, ester, or anhydride is blown into a mixture of water and an amine. Generally the amine and sulfurous acid, anhydride, or ester are reacted in equal molar amounts.

This intermediate is then further reacted with a sulfur source to form the organic ammonium thiosulfate. The temperature is generally from about room temperature up to the decomposition temperature of the individual reactants or the reaction mixture. Typically, the reaction temperature is from about 20° C., or from about 30° C. up to about 300° C., or up to about 200° C., or up to about 150° C. Typically, from about 0.1, or from about 0.3, or from about 0.5 up to about 10, or up to about 5, or up to about 1.5 equivalents of sulfur is reacted with each equivalent of sulfur present from the sulfurous acid, ester, or anhydride. Typically, an equivalent of the sulfur source is reacted with an equivalent of the reaction product of the amine and sulfurous acid, ester, or anhydride. The equivalents of reaction product is determined on a sulfur basis.

The sulfur source may be any of a variety of materials which are capable of supplying sulfur to the reaction. Examples of useful sulfur sources include elemental sulfur, sulfur halides, combinations of sulfur or sulfur oxides with hydrogen sulfide, and various sulfur containing organic compounds. The sulfur halides include sulfur monochloride, sulfur dichloride, etc. The sulfur sources may also be sulfur containing organic compounds, such as aromatic and alkyl sulfides, dialkenyl sulfides, sulfurized olefins, sulfurized oils, sulfurized fatty acid esters, sulfurized aliphatic esters of olefinic mono- or dicarboxylic acids, diester sulfides, sulfurized Diels-Alder adducts and sulfurized terpenes. U.S. Pat. No. 4,755,311 discloses various sulfur sources capable of supplying sulfur to reactions. This patent is incorporated by reference for its disclosure of sulfur sources.

The following examples relate to organic ammonium thiosulfates. As used in the following examples, as well as elsewhere in the specification and claims, all parts and percentages are by weight, the temperature is in degrees celsius, and the pressure is atmospheric pressure.

EXAMPLE 1

A reaction vessel is charged with 200 grams (1 equivalent) of Primerie 81R, 100 milliliters of toluene, and 100 grams of 100 neutral mineral oil. The mixture is heated to 50° C., where 74 grams (0.5 equivalent) of ammonium thiosulfate, dissolved in 100 grams of water, is added to the reaction vessel over 60 minutes. The mixture is heated to reflux and the temperature is maintained for one hour. Ammonia evolves from the reaction. The reaction is heated to 120° C., where 100 milliliters of aqueous distillate is recovered. The reaction mixture is cooled to room temperature where 100 grams of 100 neutral mineral oil is added to the vessel. The mixture is heated to 60° C. where 100 milliliters of water is added to the vessel. The mixture is heated to reflux (90° C.) and the temperature is maintained for 15 hours. The reaction vessel is heated to 110°-120° C. and the temperature is maintained for 16 hours. The reaction mixture is cooled to room temperature and the upper liquid layer is decanted. The liquid layer is the desired product. The product contains 31% mineral oil and 31% toluene. The product contains 3.4 % sulfur, 3.1% nitrogen, and has a 46.3 total acid number and a 54.4 total base number.

EXAMPLE 2

A reaction vessel is charged with 229 parts (1 mole) of Surfam PA14, and 100 milliliters of 100 neutral mineral oil. Ammonium thiosulfate (74 grams, 0.5 mole) dissolved in 100 milliliters of water is added dropwise to the vessel. The mixture is heated to 75° C. and held for one hour. More mineral oil (100 grams) is added over one hour at 75° C. The reaction is cooled to room temperature. Toluene (100 grams) is added to the vessel, and the mixture is heated to reflux (80°-110° C.) while removing aqueous distillate azeotropically. A total of 106 milliliters of aqueous distillate is removed in 6 hours. The reaction mixture is stripped at 110° C. and 15 mm Hg. The residue is filtered through diatomaceous earth and the filtrate is the desired product. The product contains 42.6% oil, 3.8% sulfur, 2.6% nitrogen, and has a 31.8 total acid number and a 26.8 total base number.

EXAMPLE 3

A reaction vessel is charged with 500 grams (1 equivalent) of a 40% oil solution of a reaction product of a polybutenyl ($\overline{Mn}$=950) substituted succinic anhydride reacted with a polyamine bottom generally having the structure of tetraethylene pentamine (wherein the reaction product has a total base number of 70 and 2.5 % nitrogen). The reaction temperature is increased to 105° C., where 37 grams (0.5 equivalent) of ammonium thiosulfate, dissolved in 50 grams of water, is added dropwise under a 1.5 standard cubic foot per hour (SCFH) nitrogen flow. Reaction temperature is increased to 100°-120° C., and is maintained for 8 hours while removing aqueous distillate. A total of 50 milliliters of aqueous distillate is removed. The reaction mixture is filtered through diatomaceous earth. The filtrate is the desired product. The product has 2.4% nitrogen, 2.2% sulfur, and has a 20.5 total acid number and a 20.7 total base number.

EXAMPLE 4

A reaction vessel is charged with 95 grams (0.5 equivalent) of Primene 81R, 144 grams (0.5 equivalent) of oleylamine, and 9 grams of water. The mixture is blown with sulfur dioxide at 0.5 standard cubic foot per hour (SCFH) for 1.5 hours. The temperature rises to 50° C. Toluene (100 milliliters) is added to the reaction vessel and the temperature is increased to 70° C. The mixture is then blown with $SO_2$ for 1 hour at 0.5 SCFH. The total moles of sulfur dioxide added to the vessel is 1.56 moles. The reaction temperature is increased to 100°-120° C. where sixteen grams (0.5 equivalent) of sulfur is added to the reaction vessel. The reaction temperature is maintained at 100°-120° C. for four hours. Infrared analysis indicates the presence of a band at 1036 $cm^{-1}$. The product is stripped to 120° C. and 15 mm Hg. The residue is filtered through diatomaceous earth. The filtrate is the desired product and contains 13.7 % sulfur.

EXAMPLE 5

A reaction vessel is charged with 242 grams (1 mole) of Armeen 16D (an amino rodecane, available commercially from Akzo Chemical Co.), and 200 grams of toluene. The mixture is heated to 50° C., where 75 grams (0.5 moles) of ammonia thiosulfate, dissolved in 100 milliliters of water, is added to the vessel over 1 hour. Then, 100 grams of 100 neutral mineral oil and 100 grams of toluene are added to the reaction vessel. Five drops of silicon antifoam agent and 50 grams of a 50/50 by weight mixture of isobutyl and amyl alcohol is added to the reaction vessel. The reaction mixture is blown with nitrogen at 85° C., removing 75 milliliters of aqueous distillate. An additional 100 grams of 100 neutral mineral oil is added to the reaction mixture and the mixture is heated to 100 ° C. while removing aqueous distillate. Total aqueous distillate removed is 130 milliliters. The reaction mixture is vacuum stripped at 120° C. and 10 mm Hg. The residue is the desired product. The product has 5.5 % sulfur, 1.9% nitrogen, a 59.7 total acid number and a 3.6 total base number.

EXAMPLE 6

A reaction vessel is charged with 560 grams (1 equivalent) of the 40 percent oil solution of the reaction product of polybutene substituted succinic anhydride and a polyamine bottom of Example 3, and 9 grams of water. The mixture is heated to 60° C. and blown with $SO_2$ at a rate of 1.0 SCFH for 3.5 hours. The temperature increases exothermically to 80°-90° C. Infrared analysis shows bands at 1153 $cm^{-1}$ and 953 $cm^{-1}$. Sulfur (16 gram, 0.5 equivalent) is added to the reaction mixture. The reaction temperature is increased 125° C. and the temperature is maintained for 1.5 hours. Infrared analysis shows disappearance of the above IR infrared bands.

Infrared bands at 1036 $cm^{-1}$ and 1229 $cm^{-1}$ are present in the reaction mixture. The reaction mixture is filtered through diatomaceous earth to yield a light brown filtrate. The filtrate is the desired product and has 4.7 % sulfur.

EXAMPLE 7

A reaction vessel is charged with 350 grams (1 equivalent) of Duomeen T (N-tallow-1,3-diaminopropane, available commercially from Akzo Chemical Co.) and 9 grams of water. The mixture is blown with sulfur dioxide at 0.5 SCFH for two hours to yield a white pasty material which is toluene soluble. An infrared band at 980 $cm^{-1}$is present in the material. Toluene (300 milliliters) is added to the reaction vessel with stirring. Sulfur (16 grams, 0.5 equivalent) is added to the reaction mixture at 100° C. The reaction mixture is stirred for 8 hours at 100°-120° C. Water (16-18 milliliters) is removed. The reaction mixture is stripped under vacuum at 120° C. and 20 mm Hg. The residue is the desired product and has 9.5 % sulfur.

EXAMPLE 8

A reaction vessel is charged with 14 grams of water and 976 grams (1.5 equivalents) of a 40% by weight at solution of a reaction product of one equivalent of polybutenyl ($\overline{M}n=950$) substituted succinic anhydride and 1.65 equivalents of polyamine prepared by condensing tris(hydroxymethyl) amino methane with HPA Taft amine, as described in U.S. Pat. No. 5,053,152, Example II. This mixture is blown with $SO_2$ at one SCFH for 4.5 hours at a temperature of 70°-90° C. Infrared analysis shows bands at 953 $cm^{-1}$, 1160 $cm^{-1}$ and 1229 $cm^{-1}$. Sulfur (24 grams, 0.75 equivalents) is added to the reaction mixture at 80°-90° C. The reaction temperature is increased to 120°-140° C. and the temperature is maintained for four hours. The reaction is filtered through diatomaceous earth. The filtrate is the desired product. The product contains 4.2 % sulfur.

Phosphorus or Boron Agents (B)

In one embodiment, the organic ammonium thiosulfate is used in combination with at least one phosphorus or boron containing antiwear/extreme pressure agent (B) . In this embodiment, (B) is present in an amount sufficient to impart antiwear, antiweld, and/or extreme pressure properties to the lubricants and functional fluids. The phosphorus or boron containing agents (B) are typically present in the lubricants and functional fluids at a level of up to about 20% by weight, preferably up to about 10 % by weight, based on the total weight of the lubricant, functional fluid, or grease. Typically, the phosphorus or boron containing antiwear/extreme pressure agent is present in the lubricants and functional fluids at a level from about 0.01%, or from about 0.05 %, or from about 0.08 % by weight. The phosphorus or boron containing antiwear/extreme pressure agent is present in an amount up to about 10%, or up to about 3 %, or up to about 1% by weight.

Examples of phosphorus or boron containing antiwear/extreme pressure agents (B) include a metal thiophosphate; a phosphoric acid ester or salt thereof; a phosphite; a phosphorus-containing carboxylic ester, ether, or amide; a borated dispersant; an alkali metal or a mixed alkali metal, alkaline earth metal borate; a borated overbased compound; a borated phospholipid; and a borate ester. The phosphorus acids include the phosphoric, phosphonic, phosphinic and thiophosphoric acids including dithiophosphoric acid as well as the monothiophosphoric acid, thiophosphinic and thiophosphonic acids.

In one embodiment, (B) is a phosphorus acid ester prepared by reacting one or more phosphorus acid or anhydride with an alcohol containing from one, or from about 3 carbon atoms. The alcohol generally contains up to about 30, preferably up to about 24, more preferably up to about 12 carbon atoms. The phosphorus acid or anhydride is generally an inorganic phosphorus reagent, such as phosphorus pentaoxide, phosphorus trioxide, phosphorus tetraoxide, phosphorus acid, phosphorus halide, lower phosphorus esters, or a phosphorus sulfide, and the like. Lower phosphorus acid esters contain from 1 to about 7 carbon atoms in each ester group. The phosphorus acid ester may be a mono-, di-, or triphosphoric acid ester. Alcohols used to prepare the phosphorus acid esters include butyl, amyl, 2-ethylhexyl, hexyl, octyl, oleyl, and cresol alcohols. Examples of commercially available alcohols include Alfol 810 (a mixture of primarily straight chain, primary alcohols having from 8 to 10 carbon atoms); Alfol 1218 (a mixture of synthetic, primary, straight-chain alcohols containing 12 to 18 carbon atoms); Alfol 20+alcohols (mixtures of $C_{18}$°$C_{28}$ primary alcohols having mostly $C_{20}$ alcohols as determined by GLC (gas-liquid-chromatography)); and Alfol 22 +alcohols ($C_{18}$-$C_{28}$ primary alcohols containing primarily $C_{22}$ alcohols). Alfol alcohols are available from Continental Oil Company. Another example of a commercially available alcohol mixtures are Adol 60 (about 75 % by weight of a straight chain $C_{22}$ primary alcohol, about 15 % of a $C_{20}$ primary alcohol and about 8 % of $C_{18}$ and $C_{24}$ alcohols) and Adol 320 (oleyl alcohol). The Adol alcohols are marketed by Ashland Chemical.

A variety of mixtures of monohydric fatty alcohols derived from naturally occurring triglycerides and ranging in chain length of from $C_8$ to $C_{18}$ are available from Procter & Gamble Company. These mixtures contain various amounts of fatty alcohols containing mainly 12, 14, 16, or 18 carbon atoms. For example, CO-1214 is a fatty alcohol mixture containing 0.5% of $C_{10}$ alcohol, 66.0% of $C_{12}$ alcohol, 26.0% of $C_{14}$ alcohol and 6.5 % of $C_{16}$ alcohol.

Another group of commercially available mixtures include the "Neodol" products available from Shell Chemical Co. For example, Neodol 23 is a mixture of $C_{12}$ and $C_{13}$ alcohols; Neodol 25 is a mixture of $C_{12}$ and $C_{15}$ alcohols; and Neodol 45 is a mixture of $C_{14}$ to $C_{15}$ linear alcohols. Neodol 91 is a mixture of $C_9$, $C_{10}$ and $C_{11}$ alcohols.

Fatty vicinal diols also are useful and these include those available from Ashland Oil under the general trade designation Adol 114 and Adol 158. The former is derived from a straight chain alpha olefin fraction of $C_{11}$-$C_{14}$, and the latter is derived from a $C_{15}$-$C_{18}$ fraction.

Examples of useful phosphorus acid esters include the phosphoric acid di- and tri- esters prepared by reacting a phosphoric acid or anhydride with cresol alcohols. An example is tricresylphosphate.

In another embodiment, the phosphorus acid ester or salt thereof is a thiophosphorus ester or salt thereof. The thiophosphorus acid ester may be prepared by reacting a phosphorus sulfide, such as phosphorus pentasulfide, with an alcohol, such as those described above. The thiophosphorus acid esters may be mono- or dithiophosphorus acid esters. Thiophosphorus acid esters are also referred to generally as thiophosphoric acids.

In one embodiment, the phosphorus acid ester is a monothiophosphoric acid ester or a monothiophosphate. In one embodiment, monothiophosphates are prepared by the reaction of a sulfur source with a dihydrocarbyl phosphite. The sulfur source such as those described herein. Elemental sulfur is a preferred sulfur source. The preparation of monothiophosphates is disclosed in U.S. Pat. No. 4,755,311 and PCT Publication WO 87/07638, which are incorporated herein by reference for their disclosure of monothiophosphates, sulfur sources, and the process for making monothiophosphates. Monothiophosphates may also be formed in the lubricant blend by adding a dihydrocarbyl phosphite to a lubricating composition containing a sulfur source, such as a sulfurized olefin. The phosphite may react with the sulfur source under blending conditions (i.e., temperatures from about 30° C. to about 100° C. or higher) to form the monothiophosphate.

In another embodiment, phosphorus acid ester is a dithiophosphoric acid or phosphorodithioic acid. The dithiophosphoric acid may be represented by the formula $(R_4O)_2PSSH$ wherein each $R_4$ is independently a hydrocarbyl group containing from 3 to about 30 carbon atoms. $R_4$ generally contains up to about 18, or to about 12, or to about 8 carbon atoms. Examples $R_4$ include isopropyl, isobutyl, n-butyl, sec-butyl, the various amyl, n-hexyl, methylisobutyl carbinyl, heptyl, 2-ethylhexyl, isooctyl, nonyl, behenyl, decyl, dodecyl, and tridecyl groups. Illustrative lower alkylphenyl $R_4$ groups include butylphenyl, amylphenyl, heptylphenyl, etc. Examples of mixtures of $R_4$ groups include: 1-butyl and 1-octyl; 1-pentyl and 2-ethyl-1-hexyl; isobutyl and n-hexyl; isobutyl and isoamyl; 2-propyl and 2-methyl-4-pentyl; isopropyl and sec-butyl; and isopropyl and isooctyl.

In one embodiment, the dithiophosphoric acid may be reacted with an epoxide or a glycol. This reaction product may be used alone, or further reacted with a phosphorus acid, anhydride, or lower ester. The epoxide is generally an aliphatic epoxide or a styrene oxide. Examples of useful epoxides include ethylene oxide, propylene oxide, butene oxide, octene oxide, dodecene oxide, styrene oxide, etc. Propylene oxide is preferred. The glycols may be aliphatic glycols, having from 1 to about 12, preferably from about 2 to about 6, more preferably 2 or 3 carbon atoms, or aromatic glycols. Glycols include ethylene glycol, propylene glycol, catechol, resorcinol, and the like. The dithiophosphoric acids, glycols, epoxides, inorganic phosphorus reagents and methods of reacting the same are described in U.S. Pat. No. 3,197,405 and U.S. Pat. No. 3,544,465 which are incorporated herein by reference for their disclosure to these.

The following Examples P-1 and P-2 exemplify the preparation of useful phosphorus acid esters.

EXAMPLE P-1

Phosphorus pentoxide (64 grams) is added at 58° C. over a period of 45 minutes to 514 grams of hydroxypropyl O,O-di(4-methyl-2pentyl)phosphorodithioate (prepared by reacting di(4-methyl-2pentyl)-phosphorodithioic acid with 1.3 moles of propylene oxide at 25° C.). The mixture is heated at 75° C. for 2.5 hours, mixed with a diatomaceous earth and filtered at 70° C. The filtrate contains 11.8% by weight phosphorus, 15.2 % by weight sulfur, and an acid number of 87 Coromophenol blue).

EXAMPLE P-2

A mixture of 667 grams of phosphorus pentoxide and the reaction product of 3514 grams of diisopropyl phosphorodithioic acid with 986 grams of propylene oxide at 50° C. is heated at 85° C. for 3 hours and filtered. The filtrate contains 15.3 % by weight phosphorus, 19.6% by weight sulfur, and an acid number of 126 (bromophenol blue).

Acidic phosphoric acid esters may be reacted with an amine compound or metallic base to form an amine or metal salt. The salts may be formed separately and then the salt of the phosphorus acid ester may be added to the lubricating composition. Alternatively, the salts may also be formed in situ when the acidic phosphorus acid ester is blended with other components to form a fully formulated lubricating composition.

The amine salts of the phosphorus acid esters may be formed from ammonia or one or more of the above described amines, including monoamines and polyamines.

Other useful amines include hydroxyamines. Typically, the hydroxyamines are primary, secondary or tertiary alkanolamines or mixtures thereof. Such amines can be represented by the formulae:

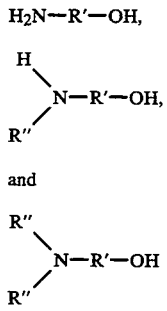

wherein each R″ is independently a hydrocarbyl group of one to about eight carbon atoms or hydroxyhydrocarbyl group of two to about eight carbon atoms, preferably one to about four, and R′ is a divalent hydrocarbyl group of about two to about 18 carbon atoms, preferably two to about four. The group —R′—OH in such formulae represents the hydroxyhydrocarbyl group. R′ can be an acyclic, alicyclic or aromatic group. Typically, R′ is an acyclic straight or branched alkylene group such as an ethylene, 1,2-propylene, 1,2-butylene, 1,2-octadecylene, etc. group. Where two R groups are present in the same molecule they can be joined by a direct carbon-to-carbon bond or through a heteroatom (e.g., oxygen, nitrogen or sulfur) to form a 5-, 6-, 7- or 8-membered ring structure. Examples of such heterocyclic amines include N-(hydroxyl lower alkyl)-morpholines, -thiomorpholines, -piperidines, -oxazolidines, -thiazolidines and the like. Typically, however, each R is independently a methyl, ethyl, propyl, butyl, pentyl or hexyl group.

Examples of these alkanolamines include mono-, di-, and triethanolamine, diethylethanolamine, ethylethanolamine, butyldiethanolamine, etc.

The hydroxyamines can also be an ether N-(hydroxyhydrocarbyl)amine. These are hydroxypoly(hydrocarbyloxy) analogs of the above-described hydroxy amines (these analogs also include hydroxyl-substituted oxyalkylene analogs). Such N-(hydroxyhydrocarbyl) amines can be conveniently prepared by reaction of epoxides with aforedescribed amines and can be represented by the formulae:

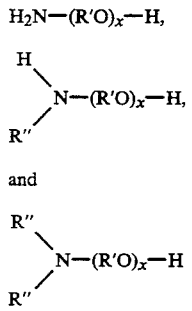

wherein x is a number from about 2 to about 15 and R'' and R' are as described above. R'' may also be a hydroxypoly(hydrocarbyloxy) group.

In one embodiment, the amines may be hydroxyamines, such as those represented by the formula

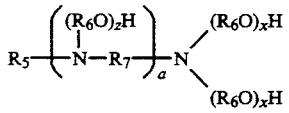

wherein: $R_5$ is a hydrocarbyl group generally containing from about 6 to about 30 carbon atoms; each $R_6$ and $R_7$ are independently an alkylene group containing up to about 5 carbon atoms, preferably an ethylene or propylene group; a is zero or one; and each x is independently a number from zero to about 10, with the proviso that at least one is at least one.

These hydroxyamines can be prepared by techniques well known in the art and many such hydroxyamines are commercially available. The hydroxy amines include mixtures of amines such as obtained by the hydrolysis of fatty oils (e.g., tallow oils, sperm oils, coconut oils, etc.). Specific examples of fatty amines, containing from about 6 to about 30 carbon atoms, include saturated as well as unsaturated aliphatic amines such as octyl amine, decyl amine, lauryl amine, stearyl amine, oleyl amine, dodecyl amine, and octadecyl amine.

Useful hydroxyamines wherein a in the above formula is zero include 2-hydroxyethyl,hexylamine; 2-hydroxyethyl, octylamine; 2-hydroxyethyl, pentadecylamine; 2-hydroxyethyl, oleylamine; 2-hydroxyethyl,soyamine; bis(2-hydroxyethyl) hexylamine; bis(2-hydroxyethyl) oleylamine; and mixtures thereof. Also included are the comparable members wherein in the above formula at least one of x and y is at least 2, as for example, 2-hydroxyethoxyethyl, hexylamine.

A number of hydroxyamines, wherein a in the above formula is zero, are available from the Armak Chemical Division of Akzona, Inc., Chicago, Ill., under the general trade designations "Ethomeen" and "Propomeen". Specific examples of such products include: Ethomeen C/15 which is an ethylene oxide condensate of a coconut fatty acid containing about 5 moles of ethylene oxide; Ethomeen C/20 and C/25 which are ethylene oxide condensation products from coconut fatty acid containing about 10 and 15 moles of ethylene oxide, respectively; Ethomeen O/12 which is an ethylene oxide condensation product of oleyl amine containing about 2 moles of ethylene oxide per mole of amine; Ethomeen S/15 and S/20 which are ethylene oxide condensation products with stearyl amine containing about 5 and 10 moles of ethylene oxide per mole of amine, respectively; Ethomeen T/12, T/15 and T/25 which are ethylene oxide condensation products of tallow amine containing about 2, 5 and 15 moles of ethylene oxide per mole of amine, respectively; and Propomeen O/12 which is the condensation product of one mole of oleyl amine with 2 moles propylene oxide.

Commercially available examples of alkoxylated amines, where a in the above formula is one, include Ethoduomeen T/13 and T/20 which are ethylene oxide condensation products of N-tallow trimethylene diamine containing 3 and 10 moles of ethylene oxide per mole of diamine, respectively.

The metal salts of the phosphorus acid esters are prepared by the reaction of a metal base with the phosphorus acid ester. The metal base may be any metal compound capable of forming a metal salt. Examples of metal bases include metal oxides, hydroxides, carbonates, sulfates, borates, or the like. The metals of the metal base include Group IA, IIA, IB through VIIB, and VIII metals (CAS version of the Periodic Table of the Elements). These metals include the alkali metals, alkaline earth metals and transition metals. In one embodiment, the metal is a Group IIA metal, such as calcium or magnesium, a Group IB metal, such as copper, a Group lIB metal, such as zinc, or a Group VIIB metal, such as manganese. Preferably the metal is magnesium, calcium, copper or zinc. Examples of metal compounds which may be reacted with the phosphorus acid include zinc hydroxide, zinc oxide, copper hydroxide, copper oxide, etc.

In one embodiment, (B) is a metal thiophosphate, preferably a metal dithiophosphate. The metal thiophosphate is prepared by means known to those in the art. Examples of metal dithiophosphates include zinc isopropyl, methylamyl dithiophosphate, zinc isopropyl isooctyl dithiophosphate, barium di(nonyl) dithiophosphate, zinc di(cyclohexyl) dithiophosphate, copper di(isobutyl) dithiophosphate, calcium di(hexyl) dithiophosphate, zinc isobutyl isoamyl dithiophosphate, and zinc isopropyl secondary-butyl dithiophosphate.

The following Examples P-3 to P-6 exemplify the preparation of useful phosphorus acid ester salts.

EXAMPLE P-3

A reaction vessel is charged with 217 grams of the filtrate from Example P-1. A commercial aliphatic primary amine (66 grams), having an average molecular weight of 191 in which the aliphatic radical is a mixture of tertiary alkyl radicals containing from 11 to 14 carbon atom, is added over a period of 20 minutes at 25°-60° C. The resulting product has a phosphorus content of 10.2% by weight, a nitrogen content of 1.5 % by weight, and an acid number of 26.3.

EXAMPLE P-4

The filtrate of Example P-2 ( 1752 grams) is mixed at 25°-82° C. with 764 grams of the aliphatic primary amine used in of Example P-3. The resulting product has 9.95% phosphorus, 2.72% nitrogen, and 12.6% sulfur.

EXAMPLE P-5

Phosphorus pentoxide (852 grams) is added to 2340 grams of iso-octyl alcohol over a period of 3 hours. The temperature increases from room temperature but is maintained below 65 ° C. After the addition is complete the reaction mixture is heated to 90° C. and the temperature is maintained for 3 hours. Diatomaceous earth is added to the mixture, and the mixture is filtered. The filtrate has 12.4 % phosphorus, a 192 acid neutralization number (bromophenol blue) and a 290 acid neutralization number (phenolphthalein).

The above filtrate is mixed with 200 grams of toluene, 130 grams of mineral oil, 1 gram of acetic acid, 10 grams of water and 45 grams of zinc oxide. The mixture is heated to 60°-70° C. under a pressure of 30 mm Hg. The resulting product mixture is filtered using a diatomaceous earth. The filtrate has 8.58% zinc and 7.03% phosphorus.

EXAMPLE P-6

Phosphorus pentoxide (208 grams) is added to the product prepared by reacting 280 grams of propylene oxide with 1184 grams of O,O'-di-isobutylphosphorodithioic acid at 30°-60° C. The addition is made at a temperature of 50°-60° C. and the resulting mixture is then heated to 80° C. and held at that temperature for 2 hours. The commercial aliphatic primary amine identified in Example P-3 (384 grams) is added to the mixture, while the temperature is maintained in the range of 30°-60° C. The reaction mixture is filtered through diatomaceous earth. The filtrate has 9.31% phosphorus, 11.37% sulfur, 2.50% nitrogen, and a base number of 6.9 (bromophenol blue indicator).

In another embodiment, (B) is a metal salt of (a) at least one dithiophosphoric acid and (b) at least one aiiphatic or alicyclic carboxylic acid. The dithiophosphoric acids are described above. The carboxylic acid may be a monocarboxylic or polycarboxylic acid, usually containing from 1 to about 3, or just one carboxylic acid group. The preferred carboxylic acids are those having the formula $R_7COOH$, wherein $R_7$ is an aliphatic or alicyclic hydrocarbyl group, preferably free from acetylenic unsaturation. Generally, $R_7$ contains from about 2, or from about 4 carbon atoms. $R_7$ may contain up to about 40, or up to about 24, or up to about 12 carbon atoms. In one embodiment, $R_7$ contains from about 4, or from about 6 up to about 12, or up to about 8 carbon atoms. In one embodiment, $R_7$ is an alkyl group. Suitable acids include the butanoic, pentanoic, hexanoic, octanoic, nonanoic, decanoic, dodecanoic, octodecanoic and eicosanoic acids, as well as olefinic acids such as oleic, linoleic, and linolenic acids, and linoleic dimer acid. A preferred carboxylic acid is 2-ethylhexanoic acid.

The metal salts may be prepared by merely blending a metal salt of a dithiophosphoric acid with a metal salt of a carboxylic acid in the desired ratio. The ratio of equivalents of dithiophosphoric acid to carboxylic acid is from about 0.5 up to about 400 to 1. The ratio may be from 0.5 up to about 200, or up to about 100, or up to about 50, or up to about 20 to 1. In one embodiment, the ratio is from 0.5 up to about 4.5 to 1, preferably from about 2.5 up to about 4.25 to 1. For this purpose, the equivalent weight of a dithiophosphoric acid is its molecular weight divided by the number of -PSSH groups therein, and the equivalent weight of a carboxylic acid is its molecular weight divided by the number of carboxy groups therein.

A second and preferred method for preparing the metal salts useful in this invention is to prepare a mixture of the acids in the desired ratio, such as those described above for the metal salts of the individual metal salts, and to react the acid mixture with one of the above described metal compounds. When this method of preparation is used, it is frequently possible to prepare a salt containing an excess of metal with respect to the number of equivalents of acid present; thus the metal salts may contain as many as 2 equivalents and especially up to about 1.5 equivalents of metal per equivalent of acid may be prepared. The equivalent of a metal for this purpose is its atomic weight divided by its valence. The temperature at which the metal salts are prepared is generally between about 30° C. and about 150° C., preferably up to about 125° C. U.S. Pat. Nos. 4,308,154 and 4,417,990 describe procedures for preparing these metal salts and disclose a number of examples of such metal salts. These patents are hereby incorporated by reference for those disclosures.

In another embodiment, (B) may also be a phosphite. The phosphite may be a di- or trihydrocarbyl phosphite. Generally, each hydrocarbyl group has from 1, or from about 2 up to about 24, or up to about 18, or up to about 8 carbon atoms. Examples of specific hydrocarbyl groups include propyl, butyl, hexyl, heptyl, octyl, oleyl, linoleyl, stearyl, phenyl, naphthyl, heptylphenol, and mixtures of two or more of thereof. In one embodiment, each hydrocarbyl group is independently propyl, butyl, pentyl, hexyl, heptyl, oleyl, or phenyl. Phosphites and their preparation are known and many phosphites are available commercially. Particularly useful phosphites are dibutyl phosphite, trioleyl phosphite and triphenyl phosphite.

In one embodiment, (B) is a phosphorus containing amide. The phosphorus containing amides are prepared by the reaction of one of the above described phosphorus acids, preferably a dithiophosphoric acid, with an unsaturated amide. Examples of unsaturated amides include acrylamide, N,N'-methylene bisacrylamide, methacrylamide, crotonamide, and the like. The reaction product of the phosphorus acid and the unsaturated amide may be further reacted with a linking or a coupling compound, such as formaldehyde or paraformaldehyde. The phosphorus containing amides are known in the art and are disclosed in U.S. Pat. Nos. 4,670,169, 4,770,807, and 4,876,374 which are incorporated by reference for their disclosures of phosphorus amides and their preparation.

In one embodiment, (B) is a phosphorus containing carboxylic ester. The phosphorus containing carboxylic esters are prepared by reaction of one of the above-described phosphorus acids, preferably a dithiophosphoric acid, and an unsaturated carboxylic acid or ester. If the carboxylic acid is used, the ester may then be formed by subsequent reaction of the phosphoric acid-unsaturated carboxylic acid adduct with an alcohol. The alcohols have been described above. In one embodiment, the alcohol has from 1 to about 12 carbon atoms.

In one embodiment, the unsaturated carboxylic ester is a vinyl ester. The vinyl ester may be represented by the formula $R_8CH{=}CH{-}O(O)CR_9$, wherein $R_8$ is hydrogen or a hydrocarbyl group having from 1 to about 30, or to about 12 carbon atoms, preferably hydrogen, and $R_9$ is a hydrocarbyl group having 1 to about 30, or to about 12, or to about 8 carbon atoms. Examples of vinyl esters include vinyl acetate, vinyl 2-ethylhexanoate, vinyl butanoate, etc.

In one embodiment, the unsaturated carboxylic acid or ester includes maleic, fumaric, acrylic, methacrylic, itaconic, citraconic acids and esters. The ester may be represented by one of the formulae: $R_{10}C{=}C(R_{11})C(O)OR_{12}$, or $R_{13}O{-}(O)C{-}HC{=}CH{-}C(O)OR_{13}$, wherein each $R_{10}$, $R_{12}$, and $R_{13}$ are each independently hydrogen or a hydrocarbyl group having 1 to about 18, or to about 12, or to about 8 carbon atoms, $R_{11}$ is hydrogen or an alkyl group having from 1 to about 6 carbon atoms. In one embodiment, $R_{11}$ is preferably hydrogen or a methyl group.

Examples of unsaturated carboxylic esters include methyl acrylate, ethyl acrylate, 2-ethylhexyl acrylate, 2-hydroxyethyl acrylate, ethyl methacrylate, 2-hydroxyethyl methacrylate, 2-hydroxypropyl methacrylate, 2-hydroxypropyl acrylate, ethyl maleate, butyl maleate and 2-ethylhexyl maleate. The above list includes mono- as well as diesters of maleic, fumaric and citraconic acids.

In one embodiment, (B) is a reaction product of a phosphorus acid, preferably a dithiophosphoric acid, and a vinyl ether. The vinyl ether is represented by the formula $R_{14}{-}CH_2{=}CH{-}OR_{15}$ wherein $R_{14}$ is independently hydrogen or a hydrocarbyl group having from 1 up to about 30, preferably up to about 24, more preferably up to about 12 carbon atoms. $R_{15}$ is a hydrocarbyl group defined the same as $R_{14}$. Examples of vinyl ethers include vinyl methylether, vinyl propylether, vinyl 2ethylhexylether and the like.

In another embodiment, (B) is an alkali metal borate. Alkali metal borates are generally a hydrated particulate alkali metal borate which are known in the art. Alkali metal borates include mixed alkali and alkaline metal borates. These alkali metal borates are available commercially. Representative patents disclosing suitable alkali metal borates and their methods of manufacture include U.S. 3,997,454; 3,819,521; 3,853,772; 3,907,601; 3,997,454; and 4,089,790. These patents are incorporated by reference for their disclosures of alkali metal borates and methods of their manufacture.

In another embodiment, (B) is a borated overbased compound. Borated overbased compounds are generally prepared by reacting an overbased compound, such as a carbonated overbased compound with a boron compound such as boric acid. The overbased compounds include basic salts (i.e., overbased salts) of alkali or alkaline earth metals with sulfonic acids, carboxylic acids, phenols or organic phosphorus acids. The phosphorus acids include those prepared by the treatment of a polyalkene with a phosphorizing agent, such as phosphorus pentasulfide. The most commonly used metals are sodium, potassium, lithium, calcium, and magnesium. The term "basic salt" is used to designate metal salts wherein the metal is present in stoichiometrically larger amounts than the organic acid radical. The overbased salts and borated overbased salts are prepared by means known to those in the art. Examples of borated overbased compounds include borated overbased sodium sulfonate, borated overbased polybutenyl ($\overline{M}n=950$) substituted succinate, and borated overbased magnesium sulfonate.

Patents describing overbased salts, methods of making the salts and components for making the same include U.S. Pat. Nos. 2,501,731; 2,616,911; 2,777,874; 3,384,585; 3,320,162; 3,488,284 and 3,629,109. The disclosure of these patents are hereby incorporated by reference. Borated overbased compositions, lubricating compositions contain the same and methods of preparing borated overbased compositions are found in U.S. Pat. Nos. 4,744,920, 4,792,410, and PCT publication WO 88/03144. The disclosure of these references are hereby incorporated by reference.

In another embodiment, (B) is a borated fatty amine. The borated amines are prepared by reacting one or more of the above boron compounds with a fatty amine, e.g., an amine having from about four up to about eighteen carbon atoms. The borated fatty amines are prepared by reacting the amine with the boron compound at about 50° C. to about 300° C., preferably about 100° C. to about 250° C., and at a ratio of 3:1 to 1:3 equivalents of amine to equivalents of boron compound.

The borated fatty epoxides are generally the reaction product of one or more of the above boron compounds with at least one epoxide. The epoxide is generally an aliphatic epoxide having at least 8, preferably at least about 10, more preferably at least about 12 up to about 24, preferably up to about 20 carbon atoms. Examples of useful aliphatic epoxides include heptyl oxide, octyl oxide, stearyl oxide, oleyl oxide and the like. Mixtures of epoxides may also be used, for instance commercial mixtures of epoxides having from about 14 to about 16 carbon atoms and from about 14 to about 18 carbon atoms. The borated fatty epoxides are generally known and are disclosed in U.S. Pat. No. 4,584,115. This patent is incorporated by reference for its disclosure of borated fatty epoxides and methods for preparing the same.

In another embodiment, (B) is a borated phospholipid. The borated phospholipids are prepared by reacting a combination of a phospholipid and a boron compound, Optionally, the combination may include an amine, an acylated nitrogen compound, a carboxylic ester, a Mannich reaction product, or a basic or neutral metal salt of an organic acid compound. These additional components are described herein. Phospholipids, sometimes referred to as phosphatides and phospholipins, may be natural or synthetic. Naturally derived phospholipids include those derived from fish, fish oil, shellfish, bovine brain, chicken egg, sunflowers, soybean, corn, and cottonseeds. Phospholipids may be derived from microorganisms, including blue-green algae, green algae, and bacteria.

The reactions usually occurs at a temperature from about 60° C., or from about 90° C. up to about 200° C., or up to about 150° C. The reaction is typically accomplished in about 0.5, or about 2 up to about 10 hours. The boron compound and phospholipid are reacted at an atomic proportion ratio of boron to phosphorus from about one up to about six to one, preferably from about two up to about four to one, more preferably about three to one. When the combination includes additional components, the boron compound is reacted with the mixture of the phospholipid and one or more optional ingredients in an amount of one atomic proportion of boron to an equivalent of the mixture of a phospholipid and an optional ingredient in a ratio from about one, or about two up to about six, to about four to one. The equivalents of the mixture are based on the combined equivalents of phospholipid based on phosphorus and equivalents of the optional ingredients.

Lubricants

As previously indicated, the organic ammonium thiosulfates (A) are useful as additives for lubricants in which they can :function primarily as antiwear, antiweld, and/or extreme pressure agents. They may be employed in a variety of lubricants based on diverse oils of lubricating viscosity, including natural and synthetic lubricating oils and mixtures thereof. These lubricants include crankcase lubricating oils for spark-ignited and compression-ignited internal combustion engines, including automobile and truck engines, two-cycle engines, aviation piston engines, marine and railroad diesel engines, and the like. They can also be used in gas engines, stationary power engines and turbines and the like. Automatic or manual transmission fluids, transaxle lubricants, gear lubricants, including open and enclosed gear lubricants, tractor lubricants, metal-working lubricants, hydraulic fluids and other lubricating oil and grease compositions can also benefit from the incorporation therein of the compositions of the present invention. They may also be used as wirerope, walking cam, way, rock drill, chain and conveyor belt, worm gear, bearing, and rail and flange lubricants.

The organic ammonium thiosulfate may be used in lubricants or in concentrates. The concentrate contains the thiosulfates alone or in combination with other components used in preparing fully formulated lubricants. The concentrate also contains a substantially inert organic diluent, which includes kerosene, mineral distillates, or one or more of the oils of lubricating viscosity discussed below. In one embodiment, the concentrates contain from 0.01%, or from about 0.1%, or from about 1% up to about 70% or up to about 80%, even up to about 90% by weight of the organic ammonium thiosulfates.

The organic ammonium thiosulfates may be present in a final product, blend, or concentrate in any amount effective to act as an antiwear, antiweld, and/or extreme pressure agent in lubricating compositions. The organic ammonium thiosulfates are generally present in the lubricating composition in an amount from about 0.01%, or from about 0.1%, or from about 0.5%, or from about 1% up to about 10%, or up to about 5 % by weight. In one embodiment, when the compositions are used in oils, such as gear oils, they are preferably present in an amount from about 0.1%, or from about 0.5 %, or from about 1%, up to about 8 %, or up to 5 %, by weight of the lubricating composition. When the organic ammonium thiosulfates are used in hydraulic fluids, the thiosulfates are generally present in an amount from about 0.01%, or from about 0.3% by weight of the hydraulic fluid. The thiosulfates may be used in hydraulic fluids in an amount up to about 2 %, or to about 1% by weight.

The lubricating compositions and methods of this invention employ an oil of lubricating viscosity, including natural or synthetic lubricating oils and mixtures thereof. Natural oils include animal oils, vegetable oils, mineral lubricating oils, and solvent or acid treated mineral oils. Synthetic lubricating oils include hydrocarbon oils (polyalpha-olefins), halo-substituted hydrocarbon oils, alkylene oxide polymers, esters of dicarboxylic acids and polyols, esters of phosphorus-containing acids, polymeric tetrahydrofurans and silicon-based oils. Unrefined, refined, and rerefined oils, either natural or synthetic, may be used in the compositions of the present invention. A description of oils of lubricating viscosity occurs in U.S. Pat. No. 4,582,618 (column 2, line 37 through column 3, line 63, inclusive), herein incorporated by reference for its disclosure to oils of lubricating viscosity.

In one embodiment, the oil of lubricating viscosity or a mixture of oils of lubricating viscosity are selected to provide lubricating compositions with a kinematic viscosity of at least about 3.5 cSt, or at least about 4.0 cSt at 100° C. In one embodiment, the lubricating compositions have an SAE gear viscosity number of at least about SAE 65, more preferably at least about SAE 75. The lubricating composition may also have a so-called multigrade rating such as SAE 75W-80, 75W-90, 75W-90, or 80W-90. Multigrade lubricants may include a viscosity improver which is formulated with the oil of lubricating viscosity to provide the above lubricant grades. Useful viscosity improvers include polyolefins, such as ethylene-propylene copolymers, or polybutylene rubbers, including hydrogenated rubbers, such as styrene-butadiene or styrene-isoprene rubbers; or polyacrylates, including polymethacrylates. Preferably the viscosity improver is a polyolefin or polymethacrylate, more preferably polymethacrylate. Viscosity improvers available commercially include Acryloid TM viscosity improvers available from Rohm & Haas; Shellvis TM rubbers available from Shell Chemical; and Lubrizol 3174 available from The Lubrizol Corporation.

In another embodiment, the oil of lubricating viscosity is selected to provide lubricating compositions for crankcase applications, such as for gasoline and diesel engines. Typically, the lubricating compositions are selected to provide an SAE crankcase viscosity number of 10W, 20W, or 30W lubricants. The lubricating composition may also have a so called multi-grade rating such as SAE 5W-30, 10W-30, 10W-40, 20W-50, etc. As described above, multi-grade lubricants include a viscosity improver which is formulated with the oil of lubricating viscosity to provide the above lubricant grades.

In one embodiment, the lubricating compositions contain less than 0.5 % by weight phosphorus. In another embodiment, the lubricating compositions are free of added lead compounds. The term "added lead compounds" refers to additives for lubricants which contain lead. In another embodiment, the lubricating compositions, such as gear lubricants, contain less than 2 %, or less than 1.5 %, or less than 1% by weight of a dispersant, such as those described herein.

Other Additives

The invention also contemplates the use of other additives in combination with the organic ammonium thiosulfates. These additives may be used in combination with the thiosulfates alone or in combination with (B) the phosphorus or boron containing antiwear/extreme pressure agent. Such additives include, for example, detergents and dispersants corrosion- and oxidation-inhibiting agents, pour point depressing agents, extreme pressure agents, antiwear agents, color stabilizers and anti-foam agents. The detergents are exemplified by oil-soluble neutral and basic salts (i.e., overbased salts) of alkali or alkaline earth metals with sulfonic acids, carboxylic acids, phenols or organic phosphorus acids, such as those described above. The dispersants are known in the art. The following are illustrative.

(1) "Carboxylic dispersants" include acylated amines, described above, and the reaction products of carboxylic acylating agents, described above, with nitrogen containing compounds (such as amine), organic hydroxy compounds (such as phenols and alcohols), and/or basic inorganic materials. These reaction products include imide, amide, and ester reaction products of carboxylic acylating agents. The carboxylic dispersants are generally prepared by reacting one or more of the above described hydrocarbyl (described above) substituted carboxylic acylating agent with an amine or hydroxy containing compound such as an alcohol. Examtetraethylene pentamine, 0.1% of a formaldehyde coupled heptylphenol and dimercaptothiadiazole, and 0.06 % of a silicone antifoam agent into a SAE 80W-90 lubricant oil mixture.

EXAMPLE VIII

A lubricant is prepared as described in Example VII except an SAE 10W-30 lubricating oil mixture is used in place of the SAE 75W-90 lubricant oil mixture.

EXAMPLE IX

A lubricant is prepared by incorporating 3% by weight of the product of Example 1; 2.4% by weight of a zinc di(2-ethylhexyl)dithiophosphate-2-ethylhexanoate prepared using zinc oxide, 2-ethylhexanoic acid, di(2-ethylhexyl)dithiophosphoric acid and triphenyl phosphite; 0.31% by weight of a carboxylic acid derivative solubilizer prepared by reacting N,N-diethylethanol amine with polybutylene succinic arthydride at a molar ratio of 1:1 wherein the polybutene succinic arthydride contains a substituent derived from a polybutene polymer having a number average molecular weight of about 1000; 1 percent by weight of a maleic anhydride-styrene copolymer esterified with $C_{8-18}$ and $C_4$ alcohols and post-treated with aminopropyl morpholine; 1% by weight of a sulfufized mixture of soybean oil and a mixture of alpha-olefins having sixteen and eighteen carbon atoms; and 3 % by weight of a dithiocarbamate ester prepared by reacting dibutyl amine with carbon disulfide and methyl acrylate into an oil mixture containing 50 % 250 neutral mineral oil and 50% 65 neutral mineral oil.

EXAMPLE X

A hydraulic fluid is prepared by mixing 0.5 % by weight of the product of Example 4; 0.1% by weight of a neutral calcium sulfonate; 0.02% by weight of Tolad 370 demulsifier available commercially from Petrolitc Chemical Company; 0.2% by weight of Ethyl Antioxidant 732; 0.01% by weight of tolytriazole; and 0.2% by weight of the esterified maleic anhydride-styrene copolymer of Example IX into a hydraulic base stock.

EXAMPLE XI

An automatic transmission fluid is prepared by mixing 4 % by weight of the product of Example 8, 0.4 % by weight of dibutyl hydrogen phosphite, 3 % Alkylate A-215 (a 237 molecular weight alkylated benzene available from Monsanto Chemical Co.), 5.3% by weight of the esterified maleic anhydride-styrene copolymer of Example IX, 420 ppm of a silicon antifoam agent and 250 ppm automate red dye available from Morton Chemical Co. into an Exxon Dextron IIE Basestock.

Grease

Where the lubricant is to be used in the form of a grease, the lubricating oil generally is employed in an amount sufficient to balance the total grease composition and, generally, the grease compositions will contain various quantifies of thickeners and other additive components to provide desirable properties. The organic ammonium thiosulfates are generally present in an amount from about 0.5 %, or from about 1% by weight. The thiosulfates may be used in an amount up to about 10%, or to about 5 % by weight.

A wide variety of thickeners can be used in the preparation of the greases of this invention. The thickener is employed in an amount from about 0.5 to about 30 percent, and preferably from 3 to about 15 percent by weight of the total grease composition. Including among the thickeners are alkali and alkaline earth metal soaps of fatty acids and fatty materials having from about 12 to about 30 carbon atoms. The metals are typified by sodium, lithium, calcium and barium. Examples of fatty materials include stearic acid, hydroxystearic acid, stearin, oleic acid, palmitic acid, myristic acid, cottonseed oil acids, and hydrogenated fish oils.

Other thickeners include salt and salt-soap complexes, such as calcium stearate-acetate (U.S. Pat. No. 2,197,263), barium stearate-acetate (U.S. Pat. No. 2,564,561), calcium stearate-caprylate-acetate complexes (U.S. Pat. No. 2,999,066), calcium salts and soaps of low-intermediate- and high-molecular weight acids and of nut oil acids, aluminum stearate, and aluminum complex thickeners. Useful thickeners include hydrophilic clays which are treated with an ammonium compound to render them hydrophobic. Typical ammonium compounds are tetraalkyl ammonium chlorides. These clays are generally crystalline complex silicates. These clays :include bentonite, attapulgite, hectorite, illite, saponite, sepiolite, biotite, vermiculite, zeolite clays and the like.

Example G-1

A grease is prepared by incorporating 4% by weight of the product of Example 1 into a lithium grease, Southwest Petro Chem Lithium 12 OH Base Grease.

EXAMPLE G-2

A grease is prepared as described in Example G-1 except 5 % by weight of the product of Example 5 is used in place of the product of Example 1.

Aqueous Compositions

The invention also includes aqueous compositions characterized by an aqueous phase with at least one organic ammonium thiosulfate dispersed or dissolved in said aqueous phase. The water-based functional fluids may be in the form of solutions; or micelle dispersions or microemulsions which appear to be true solutions. Preferably, this aqueous phase is a continuous aqueous phase although, in some embodiments, the aqueous phase can be a discontinuous phase.

These aqueous compositions usually contain at least about 25 % by weight water. Such aqueous compositions encompass both concentrates containing about 25 % to about 80% by weight, preferably from about 40% to about 65 % water; and water-based functional fluids containing generally over about 80% by weight of water. The concentrates generally contain less than about 50%, preferably less than about 25 %, more preferably less than about 15 %, and still more preferably less than about 6 % hydrocarbon oil. The water-based functional fluids generally contain less than about 15 %, preferably less than about 5 %, and more preferably less than about 2% hydrocarbon oil. The thiosulfates are generally present in the aqueous compositions in an amount from about 0.2 %, or about 0.5 %, or about 0.75 % up to about 10%, or to about 5%, or to about 2.5% of the aqueous composition.

These concentrates and water-based functional fluids can optionally include other conventional additives commonly employed in water-based functional fluids. These other additives include surfactants; thickeners; oil-soluble, water-insoluble functional additives such as antiwear agents, extreme pressure agents, dispersants, etc.; and supplemental additives such as corrosionples of these materials include succinimide dispersants and carboxylic ester dispersants. The patents describing the acylated amines also describe the carboxylic ester dispersants. The patents describing the carboxylic ester dispersants are hereby incorporated by reference.

(2) "Amine dispersants" are the reaction products of relatively high molecular weight aliphatic or alicyclic halides and amines, preferably polyalkylenepolyamines. These dispersants are described above as hydrocarbyl substituted amines.

(3) "Mannich dispersants" are the reaction products of alkylphenols and aldehydes (especially formaldehyde) and amines (especially amine condensates and polyalkylenepolyamines). These dispersants are described above as Mannich reaction products.

(4) "Post-treated dispersants" are the products obtained by post-treating the carboxylic, amine or Mannich dispersants. These dispersants are described above.

(5) "Polymeric dispersants" are interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. Polymeric dispersants include esters of styrene-maleic anhydride copolymers. Examples thereof are disclosed in the following U.S. Pat. Nos.: 3,329,658, 3,449,250, 3,519,656, 3,666,730, 3,687,849, and 3,702,300.

The above-noted patents are incorporated by reference herein for their disclosures of ashless dispersants.

Auxiliary extreme pressure agents and corrosion- and oxidation-inhibiting agents which may be included in the lubricants of the invention are exemplified by chlorinated aliphatic hydrocarbons such as chlorinated wax; phosphosulfurized hydrocarbons, such as the reaction product of a phosphorus sulfide with turpentine or methyl oleate; metal thiocarbamates, such as zinc dioctyldithiocarbamate, and barium diheptylphenyl dithiocarbamate; and sulfur compounds.

The sulfur compounds include sulfurized organic compounds, include mono- or polysulfide compositions, and dithiocarbamate containing compounds. The sulfur compounds generally are characterized as di-, tri- or tetrasulfides. The sulfur compounds include sulfurized oils, fatty acids or esters, olefins, terpenes, or Diels-Alder adducts. U.S. Pat. Nos. 3,926,822, 3,498,915, 4,119,549, 4,199,550, 4,191,659, 4,344,854, 4,582,618, and Re 2733 describe sulfur compounds and methods of making the same. These patents is hereby incorporated by reference for such description. Examples of useful sulfufized compositions include sulfufized isobutylene and diisobutylene, a sulfufized mixture of soybean oil and olefins having from sixteen to eighteen carbon atoms, a sulfufized pine oil, a sulfufized Diels-Alder adduct of butadiene and butyl-acrylate.

Dithiocarbamate-containing compositions include dithiocarbamate esters, dithiocarbamate amides, dithiocarbamic ethers, a sulfur coupled dithiocarbamate or alkylene-coupled dithiocarbamates. The dithiocarbamate containing esters, amides, and ethers are prepared by reacting a dithiocarbamic acid or salt with an unsaturated amide, ether, or ester to form the dithiocarbamate-containing compounds. The dithiocarbamate containing compositions may also be alkylene, and sulfur coupled dithiocarbamates. U.S. Pat. Nos. 1,726,647, 1,736,429, 2,599,350, 3,876,550, 4,758,362, and 4,997,969 describe dithiocarbamate containing compositions and methods of making the same. These patents are incorporated by reference for such description. Examples of dithiocarbamate containing compositions include the reaction product of dibutyl amine, carbon disulfide, and acrylamide; the reaction product of diethylamine, carbon disulfide, and methyl acrylate; and methylene or phenylene coupled dibutyl dithiocarbamate.

Pour point depressants are an additive often included in the lubricating oils described herein. Examples of useful pour point depressants are polymethacrylates; polyacrylates; polyacrylamides; condensation products of haloparaffin waxes and aromatic compounds; vinyl carboxylate polymers; and polymers of dialkylfumarates, vinyl esters of fatty acids and alkyl vinyl ethers. Pour point depressants useful for the purposes of this invention, techniques for their preparation and their uses are described in U.S. Pat. Nos. 2,387,501; 2,015,748; 2,655,479; 1,815,022; 2,191,498; 2,666,746; 2,721,877; 2,721,878; and 3,250,715 which are hereby incorporated by reference for their relevant disclosures.

Antifoam agents are used to reduce or prevent the formation of stable foam. Typical antifoam agents include silicones or organic polymers. Additional antifoam compositions are described in "Foam Control Agents", by Henry T. Kerner (Noyes Data Corporation, 1976), pages 125–162.

The following examples relate to lubricating compositions containing the organic ammonium thiosulfates.

EXAMPLE I

A lubricant is prepared by incorporating 4 % by weight of the product of Example 1 into a SAE 10W-40 lubricating oil mixture.

EXAMPLE II

A gear lubricant is prepared by incorporating 5.3 % by weight of the product of Example 1 into an SAE 90 lubricating oil mixture.

EXAMPLE III

A gear lubricant is prepared by incorporating 6 % by weight of the product of Example 1, and 0.5 % of dibutyl hydrogen phosphite into an SAE 80W-90 lubricating oil mixture.

EXAMPLE IV

A lubricant is prepared as described in Example III except a SAE 10W-40 lubricating oil mixture is used in place of the SAE 80W-90 lubricating oil mixture.

EXAMPLE V

A gear lubricant is prepare by incorporating 3 % by weight the product of Example 5, and 1.9% by weight of a zinc isopropyl, methylamyl dithiophosphate into an SAE 80W-90 lubricating oil mixture.

EXAMPLE VI

A lubricant is prepared as described in Example V except an SAE 10W-30 lubricating oil mixture is used in place of the SAE 80W-90 lubricating oil mixture.

EXAMPLE VII

A gear lubricant is prepared by incorporating 5 % of the product of Example 1, 0.75 % of the product of Example P-3, 0.25 % of oleylamine, 0.05% of a succinic dispersant containing 40% 100 neutral mineral oil and 2.5% nitrogen and prepared by reacting a polybutenyl ($\overline{Mn}$=950) substituted succinic anhydride with a commercial polyamine having the equivalent structure of inhibitors, shear stabilizing agents, bactericides, dyes, water-softeners, odor masking agents, antifoam agents and the like.

The surfactants that are useful in the aqueous compositions of the invention can be of the cationic, anionic, nonionic or amphoteric type. Many such surfactants of each type are known to the art. See, for example, McCutcheon's "Emulsifiers & Detergents", 1981, North American Edition, published by McCutcheon Division, MC Publishing Co., Glen Rock, N.J. U.S.A., which is hereby incorporated by reference for its disclosures in this regard. Specific nonionic surfactant types include alkylene oxide treated products, such as ethylene oxide treated phenols and ethylene oxide/propylene oxide block copolymers, alcohols, esters, such as glycerol esters, amines, such as the above hydroxy amines, and amides. Examples of surfactants include alkylene oxide treated alkylphenols, sold commercially under the tradename of Triton® such as Triton® X-100, available commercially from Union Carbide Chemical Company; alkoxylated amines available from Akzo Chemic under the names ETHODUOMEEN® (polyethoxylated diamines), ETHOMEEN® (polyethoxylated aliphatic amines), ETHOMID® (polyethoxylated amides), and ETHO-QUAD (polyethoxylated quaternary ammonium chlorides); tall oil acids, sold under the trade name Unitol DT/40 (available from Union Camp Corp); and the above described hydroxyamines.

Among the useful anionic surfactant types are the widely known carboxylate soaps, metal organosulfates, metal sulfonates, metal sulfonylcarboxylates, and metal phosphates. Useful cationic surfactants include nitrogen compounds such as amine oxides and the well-known quaternary ammonium salts. Amphotefic surfactants include amino acid-type materials and similar types.

Surfactants are generally employed in effective amounts to aid in the dispersal of the various additives, particularly in the functional additives discussed below of the invention. Preferably, the concentrates can contain up to about 75 % by weight, more preferably from about 10% to about 75 % by weight of one or more of these surfactants. The water-based functional fluids can contain up to about 15 % by weight, more preferably from about 0.05% to about 15% by weight of one or more of these surfactants.

Often the aqueous compositions of this invention contain at least one thickening agent. Generally, these thickening agents can be polysaccharides, including cellulose ethers and esters, such as hydroxyethyl cellulose and the sodium salt of carboxymethyl cellulose, synthetic thickening polymers, or mixtures of two or more of these. Specific examples of such gums are gum agar, guar gum, gum arabic, algin, dextrans, xanthan gum and the like. A thickener can also be synthetic thickening polymers. Representative of them are polyacrylates, polyacrylamides, hydrolyzed vinyl esters, water-soluble homo- and interpolymers of acrylamidoalkane sulfonates and other comonomers such as acrylonitrile, styrene and the like.

Preferred thickening agents include the water-dispersible reaction products formed by reacting at least one hydrocarbyl-substituted succinic acid and/or anhydride wherein the hydrocarbyl group has from about 8, or about 12, or about 16, up to about 40, or to about 30, or to about 24, about 18 carbon atoms, with at least one water-dispersible amine terminated poly(oxyalkylene) or at least one water-dispersible hydroxy-terminated polyoxyalkylene. Examples of water-dispersible amine-terminated poly(oxyalkylene)s that are useful in accordance with the present invention are disclosed in U.S. Pat. Nos. 3,021,232; 3,108,011; 4,444,566; and Re 31,522. The disclosures of these patents are incorporated herein by reference. Water-dispersible amine terminated poly(oxyalkylene)s that are useful are commercially available from the Texaco Chemical Company under the trade name Jeffamine® . Water-dispersible hydroxy-terminated polyoxyalkylenes are commercially available from BASF Wyandotte Corporation under the tradename "Tetronic" and "Pluronic". Useful hydroxy-terminated polyoxyalkylenes are disclosed in U.S. Pat. Nos. 2,674,619 and 2,979,528, which are incorporated herein by reference.

The reaction between the succinic acid and/or anhydride and the amine- or hydroxy-terminated polyoxyalkylene is described in U.S. Pat. No. 4,659,492 this patent is incorporated herein by reference for its teachings with respect to the use of the reaction product of a hydrocarbyl-substituted succinic acid or anhydride and hydroxy-terminated poly(oxyalkylene).

When the thickener is formed using an amine-terminated poly(oxyalkylene), the thickening characteristics of said thickener can be enhanced by combining it with at least one of the above surfactants. When such surfactants are used, the weight ratio of thickener to surfactant is generally in the range of from about 1:5 to about 5:1, preferably from about 1:1 to about 3:1.

Typically, the thickener is present in a thickening amount in the aqueous compositions of this invention. When used, the thickener is generally present at a level of up to about 70% by weight, preferably from about 20% to about 50% by weight of the concentrates of the invention. The thickener is preferably present at a level in the range of from about 1.5 % to about 10% by weight, preferably from about 3 % to about 6 % by weight of the functional fluids of the invention.

The functional additives that may also be included in the aqueous systems are typically oil-soluble, water-insoluble additives which function in conventional oil-based systems as extreme pressure agents, anti-wear agents, load-carrying agents, dispersants, friction modifiers, lubricity agents, etc. They can also function as anti-slip agents, film formers and friction modifiers. As is well known, such additives can function in two or more of the above-mentioned ways; for example, extreme pressure agents often function as load-carrying agents.

The term "oil-soluble, water-insoluble functional additive" refers to a functional additive which is not soluble in water above a level of about 1 gram per 100 parts of water at 25° C., but is soluble in mineral oil to the extent of at least 1 gram per liter at 25 ° C. These functional additives may also include certain solid lubricants such as graphite, molybdenum disulfide and polytetrafluoroethylene and related solid polymers. These functional additives can also include frictional polymer formers, which form materials which are dispersed in a liquid and are believed to polymerize under operating conditions. A specific example of such materials is dilinoleic acid and ethylene glycol combinations which can form a polyester frictional polymer film. These materials are known to the art and descriptions of them are found, for example, in the journal "Wear", Volume 26, pages 369–392, and West German Published Patent Application 2,339,065. These disclosures are hereby incorporated by reference for their discussions of frictional polymer formers.

Typically these functional additives are known metal or amine salts of organo sulfur, phosphorus, boron or carboxylic acids which are the same as or of the same type as used in oil-based fluids and are described above.

Many such functional additives are known to the art. For example, descriptions of additives useful in conventional oil-based systems and in the aqueous systems of this invention are found in "Advances in Petroleum Chemistry and Refining", Volume 8, edited by John J. McKetta, Interscience Publishers, New York, 1963, pages 31–38 inclusive; Kirk-Othmer "Encyclopedia of Chemical Technology", Volume 12, Second Edition, Interscience Publishers, New York, 1967, page 575 et seq.; "Lubricant Additives" by M. W. Ranney, Noyes Data Corporation, Park Ridge, N.J., U.S.A., 1973; and "Lubricant Additives" by C. V. Smallheer and R. K. Smith, The Lezius-Hiles Co., Cleveland, Ohio, U.S.A. These references are hereby incorporated by reference for their disclosures of functional additives useful in the compositions of this invention.

The functional additive can also be a film former such as a synthetic or natural latex or emulsion thereof in water. Such latexes include natural rubber latexes and polystyrene-butadienes synthetic latex.

The functional additive can also be an anti-chatter or anti-squawk agent. Examples of the former are the amide-metal dithiophosphate combinations such as disclosed in West German Patent 1,109,302; amine salt-azomethene combinations such as disclosed in British Patent Specification 893,977; or amine dithiophosphate such as disclosed in U.S. Pat. No. 3,002,014. Examples of anti-squawk agents are N-acyl-sarcosines and derivatives thereof such as disclosed in U.S. Pat. Nos. 3,156,652 and 3,156,653; sulfurized fatty acids and esters thereof such as disclosed in U.S. Pat. Nos. 2,913,415 and 2,982,734; and esters of dimerized fatty acids such as disclosed in U.S. Pat. No. 3,039,967. The above-cited patents are incorporated herein by reference for their disclosure to anti-chatter and anti-squawk agents.

Typically, the functional additive is present in a functionally effective amount. The term "functionally effective amount" refers to a sufficient quantity of an additive to impart desired properties intended by the addition of said additive.

The aqueous systems of this invention often contain at least one optional inhibitor for corrosion of either ferrous or non-ferrous metals or both. The inhibitor can be organic or inorganic in nature. Included are those described in "Protective Coatings for Metals" by Bums and Bradley, Reinhold Publishing Corporation, Second Edition, Chapter 13, pages 596–605, the disclosure of which relative to inhibitors are hereby incorporated by reference. Specific examples of useful inorganic inhibitors include alkali metal nitrites, sodium di- and tripolyphosphate, potassium and dipotassium phosphate, alkali metal borate and mixtures of the same. Specific examples of organic inhibitors include hydrocarbyl amine and hydroxy-substituted hydrocarbyl amine neutralized acid compounds, such as neutralized phosphates and hydrocarbyl phosphate esters, neutralized fatty acids, neutralized aromatic carboxylic acids (e.g., 4-tertiarybutyl benzoic acid), neutralized naphthenic acids and neutralized hydrocarbyl sulfonates. Particularly useful amines include the alkanolamines such as ethanolamine, diethanolamine.

The aqueous systems of the present invention can also include at least one bactericide. Such bactericides are well known to those of skill in the art and specific examples can be found in the aforementioned McCutcheon publication "Functional Materials" under the heading "Antimicrobials" on pages 9–20 thereof. This disclosure is hereby incorporated by reference as it relates to suitable bactericides for use in the aqueous compositions or systems of this invention.

The aqueous systems of the present invention can also include such other materials as dyes, e.g., an acid green dye; water softeners, e.g., ethylenediaminetetraacetate sodium salt or nitrilotriacetic acid; odor masking agents, e.g., citronella, oil of lemon; antifreeze additive, e.g., ethylene glycol and analogous polyoxyalkylene polyols; and antifoamants, such as the well-known silicone antifoamant agents.

Discussion of aqueous compositions and components of aqueous systems occurs in U.S. Pat. No. 4,707,301, herein incorporated by reference for its disclosure of aqueous compositions and components of aqueous compositions.

EXAMPLES IX–XII

The following examples relate to aqueous compositions containing the organic ammonium thiosulfates. The examples are prepared by mixing the components in a homogenizer.

| | IX | X | XI | XII |
|---|---|---|---|---|
| 100 neutral mineral oil | 54.0 | 54.0 | 54.0 | 54.0 |
| Water | 40.0 | 40.0 | 40.0 | 40.0 |
| Reaction product of diethylethanolamine and a polybutenyl-(Mn = 950)-substituted succinic anhydride | 3.0 | 3.5 | 3.0 | 3.5 |
| Product of Example 1 | 0.75 | 1.5 | — | — |
| Product of Example 3 | — | — | 1.0 | 0.9 |
| $(NH_4)_2HPO_4$ | 0.5 | 0.5 | 0.5 | 0.5 |

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A lubricating composition comprising a major amount of an oil of lubricating viscosity, and (A) an organic ammonium thiosulfate, wherein said lubricating composition is free of additives which contain lead.

2. The composition of claim 1 wherein the organic ammonium thiosulfate (A) contains from about 4 to about 30 carbon atoms.

3. The composition of claim 1 wherein the organic ammonium thiosulfate (A) is a tertiary aliphatic primary ammonium thiosulfate.

4. The composition of claim 1 wherein the organic ammonium thiosulfate (A) is selected from the group consisting of a tertiary octyl, a tertiary decyl, a tertiary dodecyl, a tertiary tetradecyl, a tertiary hexadecyl, and a tertiary octadecyl primary ammonium thiosulfate.

5. The composition of claim 1 wherein the organic ammonium thiosulfate (A) is an ether organic ammonium thiosulfate.

6. The composition of claim 1, wherein the organic ammonium thiosulfate is prepared by reacting an amine with a sulfurous acid, anhydride, or ester to form an intermediate, and further reacting the intermediate with a sulfur source.

7. The composition of claim 1 further comprising (B) a phosphorus or boron antiwear/extreme pressure agent.

8. The composition of claim 7 wherein (B) is selected from the group consisting of a metal dithiophosphate, a phosphoric acid ester or salt thereof. a trihydrocarbyl phosphate, a phosphite, a phosphorus-containing carboxylic ester, ether, or amide, a borated dispersant, an alkali metal or a mixture of alkali metal and alkaline earth metal borates, a borated overbased compound, and a borate ester.

9. The composition of claim 7 wherein (B) is a salt prepared by reacting the phosphoric acid ester with ammonia or an amine.

10. The composition of claim 9 wherein the amine is a tertiary aliphatic primary amine.

11. The composition of claim 7 wherein (B) is a borated dispersant and the lubricating composition contains up to about 2 % by weight of the borated dispersant.

12. The composition of claim 7 wherein (B) is a borated calcium, magnesium, or sodium overbased sulfonate or carboxylate.

13. A lubricating composition comprising a major amount of an oil of lubricating viscosity, (A) an organic ammonium thiosulfate, and (B) a phosphorus or boron antiwear/extreme pressure agent, wherein said lubricating composition is free of additives which contain lead.

14. The composition of claim 13 wherein the organic ammonium thiosulfate (A) contains from about 4 to about 30 carbon atoms.

15. The composition of claim 13 wherein the organic ammonium thiosulfate (A) is a tertiary aiiphatic primary ammonium thiosulfate.

16. The composition of claim 13 wherein the organic ammonium thiosulfate (A) is selected from the group consisting of a tertiary octyl, a tertiary decyl, a tertiary dodecyl, a tertiary tetradecyl, a tertiary hexadecyl, and a tertiary octadecyl primary ammonium thiosulfate.

17. The composition of claim 13 wherein (B) is selected from the group consisting of a metal dithiophosphate, a phosphoric acid ester or salt thereof, a trihydrocarbyl phosphate, a phosphite, a phosphorus-containing carboxylic ester, ether, or amide, a borated dispersant, an alkali metal or mixture of alkali metal and alkaline earth metal borates, a borated overbased compound, and a borate ester.

18. The composition of claim 13 wherein (B) is a phosphoric acid ester prepared by reacting a dithiophosphoric acid with an epoxide to form an intermediate and the intermediate is further reacted with a phosphorus acid or anhydride, or a salt of the phosphoric acid ester.

19. The composition of claim 13 wherein (B) is a salt prepared by reacting the phosphoric acid ester with ammonia or an amine.

20. A gear composition comprising a major amount of an oil of lubricating viscosity, and an antiwear/extreme pressure effective amount of the combination of (A) an organic ammonium thiosulfate, and (B) a phosphorus or boron antiwear/extreme pressure agent, wherein said gear composition is free of additives which contain lead.

21. An aqueous functional fluid comprising water, an organic ammonium thiosulfate, and an emulsifier, wherein said aqueous functional fluid is free of additives which contain lead.

22. The composition of claim 21 wherein the aqueous functional fluid is a hydraulic fluid, or metal working fluid.

23. A grease composition comprising an oil of lubricating viscosity, (A) an organic ammonium thiosulfate, and (B) a thickening agent, wherein said grease composition is free of additives which contain lead.

24. The composition of claim 7 wherein (B) is selected from the group consisting of a phosphoric acid ester or salt thereof, a phosphite, a phosphorus-containing carboxylic ester, ether, or amide, a borated overbased compound, and a borated phospholipid.

25. The composition of claim 13 wherein (B) is selected from the group consisting of a phosphoric acid ester or salt thereof, a phosphite, a phosphorus-containing carboxylic ester, ether, or amide, a borated overbased compound, and a borated phospholipid.

* * * * *